US005970544A

United States Patent [19]

Kardell

[11] Patent Number: 5,970,544

[45] Date of Patent: Oct. 26, 1999

[54] MATTRESS COVER

[76] Inventor: Virgil L. Kardell, 1516 Claycomb Rd., Wayne, Nebr. 68787

[21] Appl. No.: 09/057,426

[22] Filed: Apr. 8, 1998

[51] Int. Cl.[6] ..... A47G 9/02

[52] U.S. Cl. ..... 5/499; 5/496; 5/500

[58] Field of Search ..... 5/496, 497, 498, 5/499, 500

[56] References Cited

U.S. PATENT DOCUMENTS

| | | | |
|---|---|---|---|
| 3,996,633 | 12/1976 | Burke | 5/497 |
| 4,279,045 | 7/1981 | Vitale | 5/497 |
| 4,736,478 | 4/1988 | Dangerously | 5/497 X |
| 4,809,376 | 3/1989 | Boldra | 5/497 |
| 4,985,953 | 1/1991 | Seago | 5/497 |

*Primary Examiner*—Michael F. Trettel
*Attorney, Agent, or Firm*—Zarley,McKee,Thomte, Voorhees & Sease; Dennis L. Thomte

[57] ABSTRACT

A mattress cover comprising a top panel for fitting in overlaying relationship to the top surface of a mattress with the top panel having corner pockets secured to each of the corners thereof. Each of the corner pockets comprise first and second pocket portions with the first pocket portion having a general trapezoidal shape and with the second pocket portion having a generally triangular-shaped configuration. The upper edge of the first pocket portion is secured to the top panel and the side edges of the second pocket portion are secured to the bottom edge of the first pocket portion. An elastic member is secured to the side portions and the bottom portion of the first and second portions, respectively.

2 Claims, 4 Drawing Sheets

MATTRESS COVER

BACKGROUND OF THE INVENTION

1. Field of the Invention

This invention relates to a mattress cover and more particularly to a mattress cover having corner pockets for receiving the corners of a mattress.

2. Description of the Related Art

Mattress covers have been employed for many years to be positioned between the upper surface of a mattress and a bottom sheet to not only pad the mattress, but also to provide protection thereto. Many different types of mattress pads have been provided in an effort to provide a mattress cover which is easily secured to the mattress and which remains in place during use. Although many types of prior art mattresses have been previously provided, many of the mattress pads are complicated in design and therefore are quite expensive to manufacture. Further, the prior art mattress pads are not believed to be able to accommodate mattresses of varying thicknesses.

SUMMARY OF THE INVENTION

A mattress cover is described which includes a top panel which is positioned on the top surface of the mattress. The top panel has first and second end edges and first and second side edges which define corners. A corner pocket is secured to the top panel at each of the corners thereof and which are adapted to be attached to the corners of the mattress. Each of the corner pockets comprises first and second pocket portions with the first pocket portion having a trapezoidal shape including an upper edge, a lower edge, and opposite side edges with the second pocket portion being generally triangular in shape and including a lower edge and inclined opposite side edges. The second pocket portion is preferably comprised of a stretchable material. The upper edge of each of the first pocket portions is secured to the top panel whereby approximately one-half of the upper edge thereof is secured to one of the side edges of the top panel and approximately one-half thereof is secured to the adjacent end edge of the top panel. The side edges of the second pocket portion of each of the corner pockets are secured to the bottom edge of the associated first pocket portion. The bottom edge of each of the second pocket portions of each of the corner pockets and the side edges of each first pocket portion have an elastic member associated therewith to draw the said bottom edge and said side edges into engagement with the mattress. The mattress cover of this invention is not only easy to install on the mattress, but accommodates mattresses of different thicknesses. Further, the mattress cover of this invention remains in place during use.

It is therefore a principal object of the invention to provide an improved mattress cover.

Still another object of the invention is to provide an improved mattress cover including a top panel and four corner pockets secured thereto.

Still another object of the invention is to provide a mattress cover which accommodates mattresses of different thicknesses.

Yet another object of the invention is to provide a mattress cover which remains in place during use.

Still another object of the invention is to provide a mattress cover which is economical of manufacture, durable in use and refined in appearance.

These and other objects will be obvious to those skilled in the art.

DESCRIPTION OF THE PREFERRED EMBODIMENT

Figure 1:
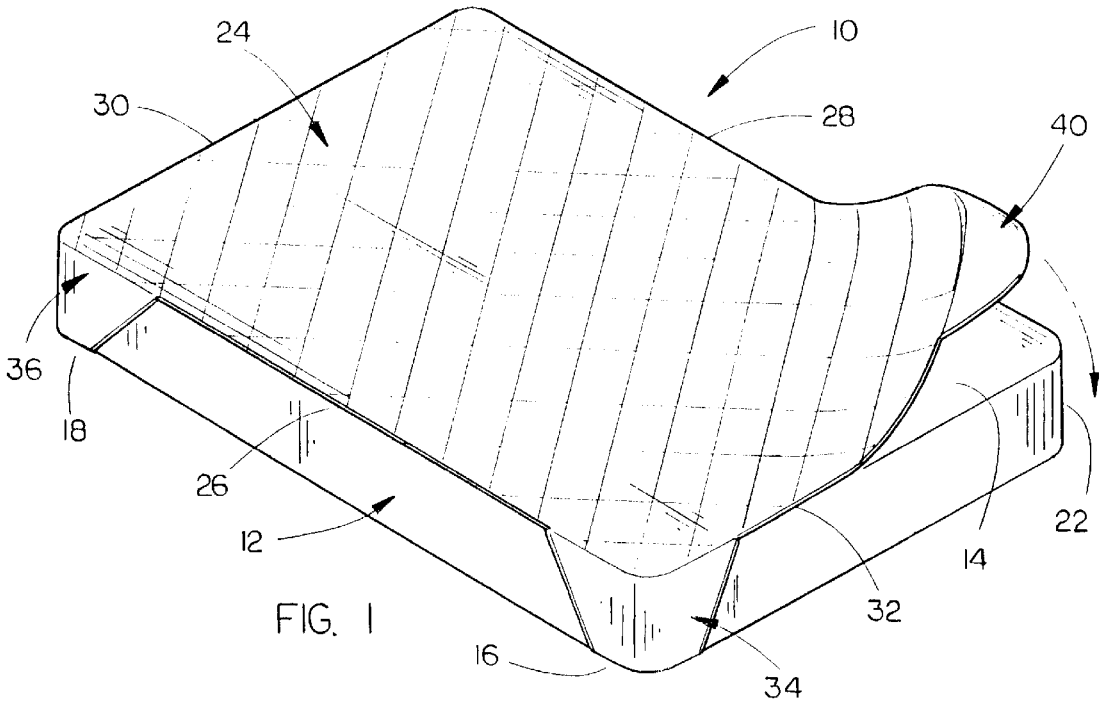
FIG. 1 is a perspective view illustrating the mattress cover of this invention being installed on a mattress.
Figure 2:
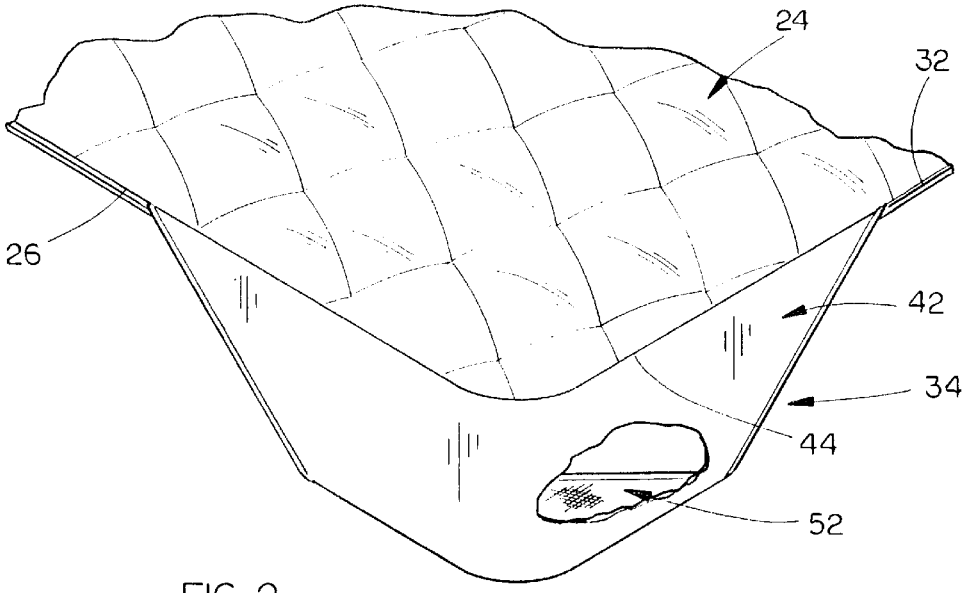
FIG. 2 is a perspective view of one corner of the mattress cover.
Figure 3:
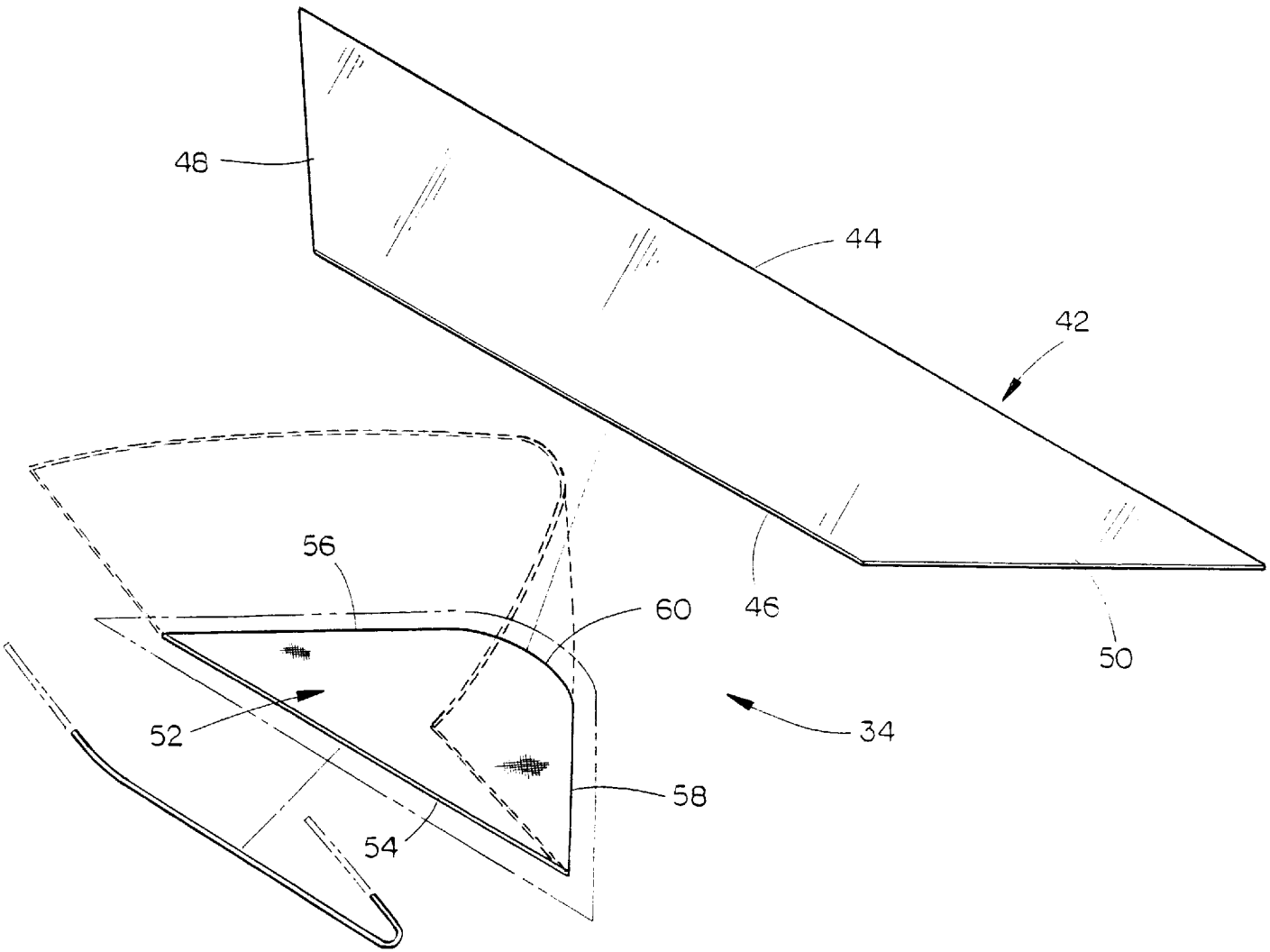
FIG. 3 is an exploded perspective view of one of the corner pockets of the mattress cover.
Figure 4:
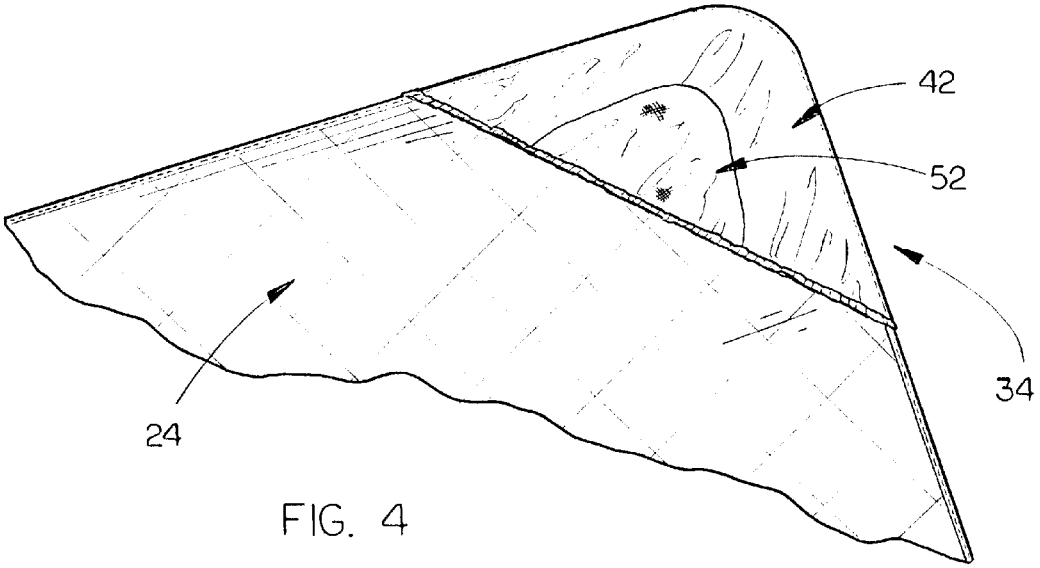
FIG. 4 is a bottom perspective view illustrating one of the corner pockets prior to the same being installed on a mattress.
Figure 5:
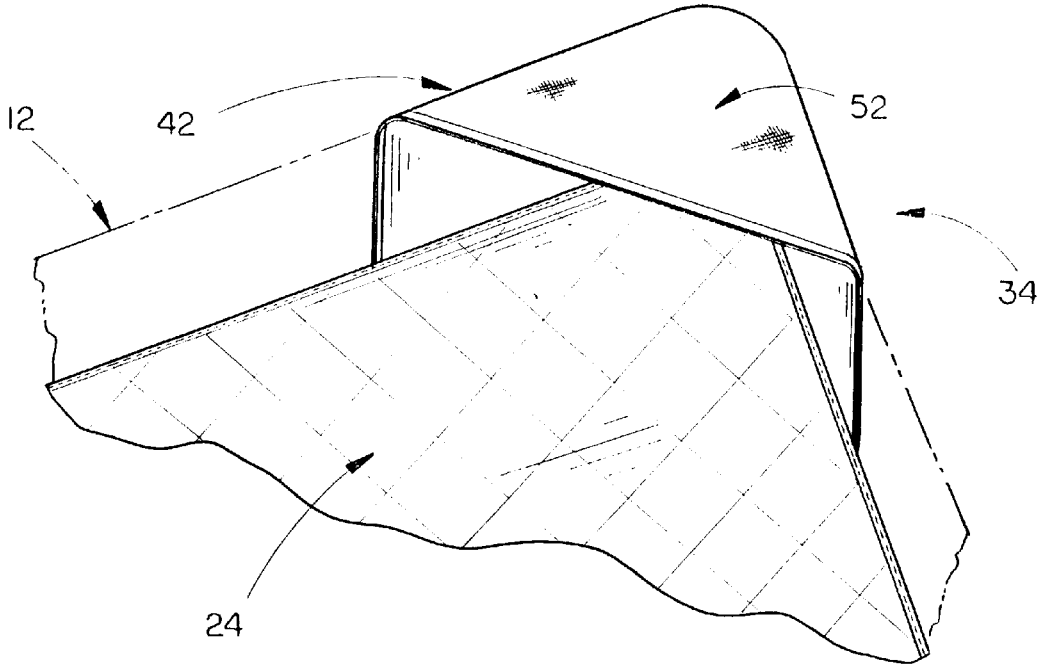
FIG. 5 is a view similar to FIG. 4 except that the corner pocket has been positioned so as to receive one corner of a mattress which is shown in dotted lines.
Figure 6:
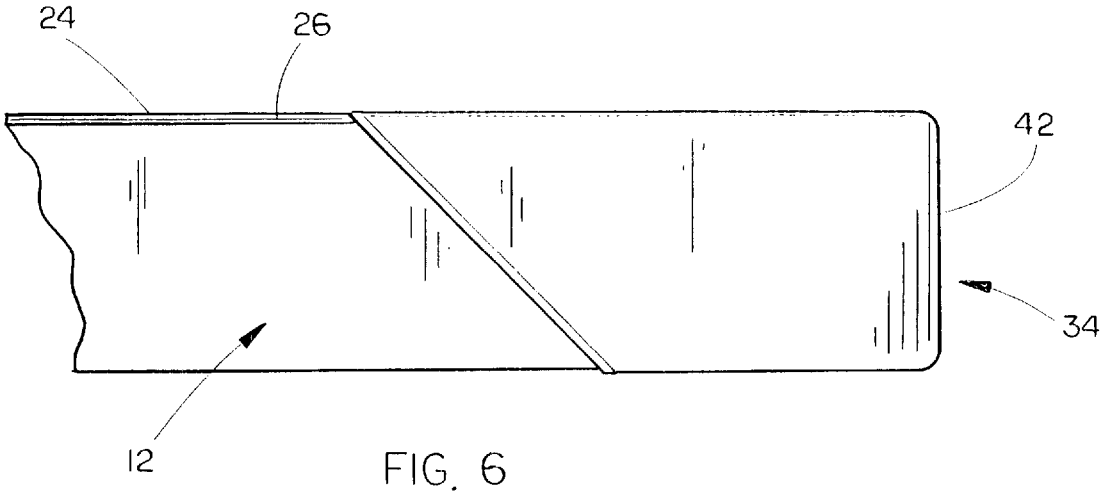
FIG. 6 is a side elevational view illustrating one corner of the mattress cover installed on a mattress.
Figure 7:
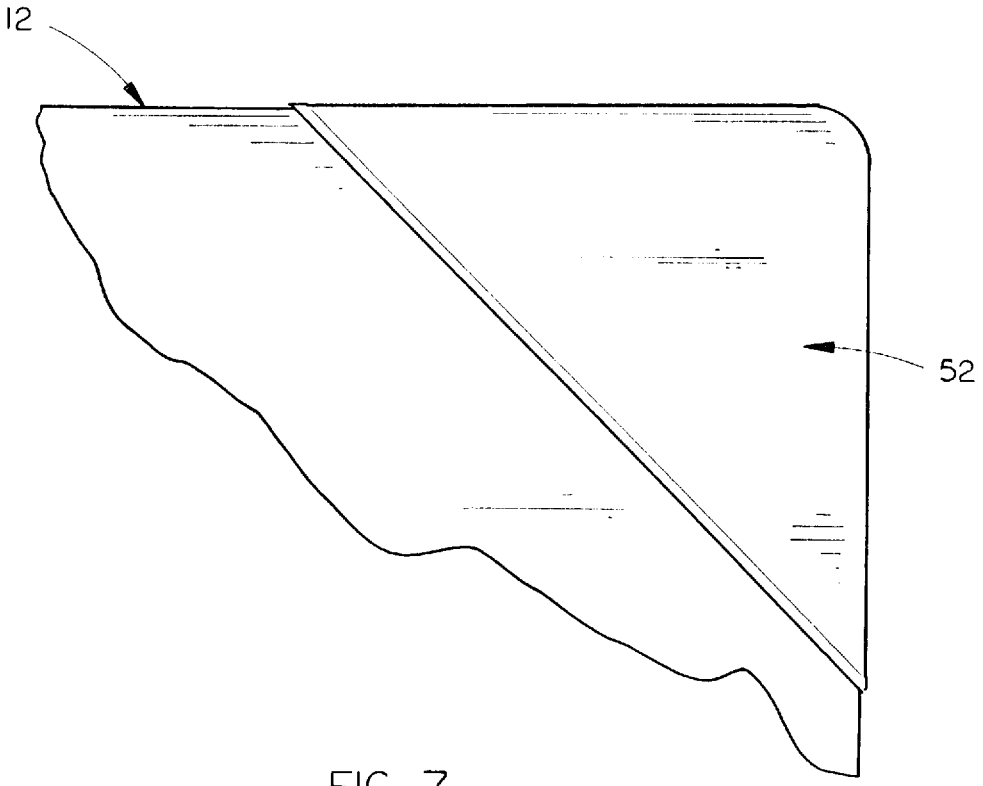
FIG. 7 is a bottom view of the mattress cover and mattress of FIG. 6.

The mattress cover of this invention is referred to generally by the reference numeral 10 and is adapted to be mounted on a mattress 12 having an upper or top surface 14 and corners 16, 18, 20 and 22.

Mattress cover 10 of this invention generally comprises a top panel 24 which is preferably padded and which includes side edges 26 and 28, top edge 30 and bottom edge 32. Mattress cover 10 also includes four corner pockets 34, 36, 38 (not shown) and 40 which are secured to the corners of the top panel 24 and which are adapted to be secured to the corners of the mattress 12. Each of the corner pockets 34, 36, 38 and 40 are identical and due to the identical construction thereof, only corner pocket 34 will be described in detail. Corner pocket 34 includes a first pocket portion 42 which is constructed of a suitable cloth material and which is trapezoidal in shape to define a top edge 44, bottom edge 46 and opposite side edges 48 and 50. Corner pocket 34, also includes a second pocket portion 52 which is comprised of a stretchable material such as Spandex™ including a lower edge 54 and opposite side edges 56 and 58. As seen in the drawings, second pocket portion 52 is generally triangular in shape except for the fact that the upper ends of side edges 56 and 58 are rounded to provide the generally arcuate upper end 60.

Assuming that corner pocket 34 is to be installed at the juncture of side edge 26 and end edge 32 of top panel 24, approximately one-half of upper edge 44 of panel portion 42 is secured to bottom edge 32 of panel 24 and the other one-half of top edge 44 is secured to side edge 26. The attachment of upper edge 44 to panel 24 is accomplished through conventional stitching. Side edges 56 and 58 of pocket portion 52 are secured to bottom edge 46 of pocket portion 42 by stitching, while pocket portion 52 is in its stretched condition. An elastic member is secured to bottom edge 54 of pocket portion 52 as well as side edges 48 and 50 of pocket portion 42.

Thus, when the pocket 34 is secured to the top panel 24, the pocket 34 will embrace the corner of the mattress, as seen in the drawings, and will accommodate mattresses of different thicknesses. The unique two-piece construction of each of the corner pockets with one of the pocket portions being constructed of a stretchable material ensures that the corner pocket will not only secure the top panel to the mattress, but that the top panel may be secured to mattresses of different thicknesses. Additionally, the mattress cover of this invention remains in place during use.

Thus it can been seen that the invention accomplishes at least all of its stated objectives.

I claim:

1. A mattress cover, comprising:

a top panel for fitting in overlaying relationship to the top surface of a mattress;

said top panel having first and second side edges and first and second end edges which define corners;

a corner pocket secured to said top panel at each of said corners for attachment to the corners of the mattress;

each of said corner pockets comprising first and second pocket portions;

said first pocket portion having a trapezoidal shape including an upper edge, a lower edge, and opposite side edges;

said lower edge of said first pocket portion having a shorter length than said upper edge;

said second pocket portion being generally triangular in shape and including a lower edge and inclined opposite side edges which extend upwardly therefrom;

said second pocket portion being comprised of a stretchable material;

said upper edge of each of said first pocket portions being secured to said top panel whereby approximately one-half of said upper edge thereof is secured to one of said side edges of said top panel and approximately one-half thereof is secured to the adjacent end edge of said top panel;

said side edges of said second pocket portions of each of said corner pockets being secured to the said bottom edge of the associated first pocket portion;

said bottom edge of each of said second pocket portions of each of said corner pockets and said side edges of said first pocket portion having an elastic member associated therewith to draw said bottom edge into engagement with the mattress.

2. The cover of claim 1 wherein the juncture of said side edges of each of said second pocket portions is arcuate.

* * * * *